US010709535B2

(12) United States Patent
Schmitt et al.

(10) Patent No.: US 10,709,535 B2
(45) Date of Patent: Jul. 14, 2020

(54) TREATMENT INSTALLATION FOR STRAWS FOR PACKAGING ANIMAL SEMEN, COMPRISING A SUPPLY AND POSITIONING DEVICE FOR SAID STRAWS

(71) Applicant: IMV Technologies, Saint Ouen sur Iton (FR)

(72) Inventors: Eric Schmitt, Villaines-la-Juhel (FR); Christian Beau, Toussus-le-Noble (FR); Joël Grosos, Saint-Ouen-sur-Iton (FR); Ludovic Lefranc, Les Aspres (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 176 days.

(21) Appl. No.: 15/928,329

(22) Filed: Mar. 22, 2018

(65) Prior Publication Data

US 2018/0271633 A1 Sep. 27, 2018

(30) Foreign Application Priority Data

Mar. 24, 2017 (FR) ..... 17 52458

(51) Int. Cl.
*A61D 19/02* (2006.01)

(52) U.S. Cl.
CPC ..... *A61D 19/024* (2013.01)

(58) Field of Classification Search
CPC ..... A61D 19/024
USPC ..... 600/33–35
See application file for complete search history.

(56) References Cited

U.S. PATENT DOCUMENTS 3,039,384 A * 6/1962 Kingsley ..... B41F 17/24 101/11
3,687,175 A * 8/1972 Babey ..... A61D 19/024 141/59
3,713,563 A * 1/1973 Dickensheets ..... B65G 47/1407 221/205
3,880,210 A * 4/1975 Randolph ..... A61D 19/024 141/175

(Continued)

FOREIGN PATENT DOCUMENTS

FR 2593482 A1 7/1987
FR 2729638 A1 7/1996

(Continued)

*Primary Examiner* — Navin Natnithithadha
*Assistant Examiner* — Sunita Reddy
(74) *Attorney, Agent, or Firm* — Browdy and Neimark, P.L.L.C.

(57) ABSTRACT

The installation (1) comprises a treatment machine (12) and a supply and positioning device (16) configured to receive the straws (2) and dispose them one by one in a predetermined orientation for their treatment by said machine. The device (16) comprises a curved ramp (52) having a reception portion (64) for the straws (2) and an ejection portion (65) for the straws, the ramp being configured to convey, to the ejection portion (65), a straw (2) received on the reception portion (64) and sliding on the ramp (52), the ramp having a concave profile such that said profile has an orientation closer to the vertical in the reception portion (64) than in the ejection portion (65), such that a straw received on the reception portion (64) is accelerated to the ejection portion (65) at which the straw is guided and ejected with a predetermined orientation.

15 Claims, 8 Drawing Sheets

(56) References Cited

U.S. PATENT DOCUMENTS

| | | | | | |
|---|---|---|---|---|---|
| 3,931,661 | A * | 1/1976 | Horsting | A46D 1/045 | 15/308 |
| 4,478,261 | A * | 10/1984 | Cassou | B65B 3/003 | 141/173 |
| 5,249,610 | A * | 10/1993 | Cassou | A61D 19/024 | 119/174 |
| 5,671,667 | A * | 9/1997 | Simmet | A61D 19/024 | 101/35 |
| 5,868,178 | A * | 2/1999 | Lecointe | A61D 19/024 | 119/174 |
| 6,035,904 | A * | 3/2000 | Beau | A61D 19/022 | 141/130 |
| 6,071,231 | A * | 6/2000 | Mendoza | A61D 19/027 | 600/35 |
| 6,213,171 | B1 * | 4/2001 | Saint-Ramon | A61D 19/024 | 141/59 |
| 8,925,289 | B2 | 1/2015 | Lecointe et al. | | |
| 2010/0000627 | A1 * | 1/2010 | Lecointe | A61D 19/024 | 141/18 |
| 2010/0200113 | A1 * | 8/2010 | Toujas | A61D 19/024 | 141/180 |
| 2011/0186463 | A1 * | 8/2011 | Kommisrud | A01N 1/0268 | 206/524.3 |
| 2011/0282135 | A1 * | 11/2011 | Waybright | A61D 19/027 | 600/35 |
| 2017/0119513 | A1 * | 5/2017 | Decherf | A61D 19/027 | |

FOREIGN PATENT DOCUMENTS

| | | | |
|---|---|---|---|
| FR | 2804416 | A1 | 8/2001 |
| FR | 2905592 | A1 | 3/2008 |

* cited by examiner

TREATMENT INSTALLATION FOR STRAWS FOR PACKAGING ANIMAL SEMEN, COMPRISING A SUPPLY AND POSITIONING DEVICE FOR SAID STRAWS

FIELD OF THE INVENTION

The invention generally relates to the preservation of a liquid-based substance containing biological material, in particular animal semen, in packaging straws filled with a predetermined dose of such a substance.

More particularly, the invention concerns a treatment installation comprising a treatment machine for such straws and a supply and positioning device configured to receive the straws and dispose them one by one in a predetermined orientation for a step of treatment of these straws by the machine, for example a printing step, or a step of filling or even of welding.

TECHNOLOGICAL BACKGROUND

Straws for packaging animal semen are conventionally formed by a thin tube of plastic material and by a stopper engaged in the thin tube. This stopper is formed by two plugs of fibrous substance which enclose a powder which transforms on contact with a liquid, into an impermeable gel or paste adhering to an inside wall of the tube, in order for the stopper to be fluid-tight.

Treatment installations and in particular those for filling and welding straws are known, which comprise a filling and welding machine configured to fill and weld straws, a movable support configured to receive the straws and convey them to the filling and welding machine, and a device for supplying and positioning the straws on the movable support.

Such an installation is for example described in French patent application FR 2 905 592.

The filling and welding machine conventionally comprises a vacuum pump and filling needles mounted on a carriage, which are configured to cooperate with the straws and to enable their filling.

The filling and welding machine further comprises a welding station configured to weld the ends of the straws after filling.

The movable support is generally formed by coaxial rotary disks each having at their periphery a plurality of cut-outs forming accommodations configured to receive the straws in a predetermined orientation.

The movable support is configured to convey the straws so accommodated thereon, from the supply and positioning device to the filling needles of the filling and welding machine for the filling of the straws, then from the filling needles to the welding station for the welding of the straws.

The supply and positioning device comprises a removable supply hopper mounted on a frame of the installation and configured to receive a plurality of straws.

The supply hopper is provided with an outlet channel in which the straws engage one after another, and the supply and positioning device further comprises a pair of levers allowing the removal of the straws from the outlet channel for the loading of these straws, one by one, into the cut-outs of the coaxial disks providing the conveyance of the straws to the filling and welding machine.

The filling and welding machine further comprises a receptacle disposed at the exit of the machine where the filled and welded straws are ejected and fall into that receptacle.

SUBJECT OF THE INVENTION

The invention is directed to providing an installation comprising a treatment machine for straws and a supply and positioning device of a kind similar to that described above, which is more convenient and provides better performance.

To that end, the invention provides a treatment installation for straws for packaging a predetermined dose of liquid-based substance, in particular animal semen, comprising at least one treatment machine for said straws and a supply and positioning device configured to receive said straws and dispose them one by one in a predetermined orientation for treatment of said straws by said machine; characterized in that said supply and positioning device comprises at least one curved ramp having a reception portion for receiving said straws and an ejection portion for ejecting said straws, which is away from said reception portion and situated lower than the latter, said curved ramp being configured to convey, to said ejection portion, a straw received on said reception portion and freely sliding on said ramp, said curved ramp having a concave profile turned upwardly such that said profile has an orientation closer to the vertical in said reception portion for receiving said straws than in said ejection portion for ejecting said straws, such that a straw received on said reception portion is accelerated to said ejection portion where said straw is guided and ejected in said predetermined orientation for treatment of said straw by said treatment machine.

By virtue of the installation according to the invention and in particular the reception portion of the supply and positioning device, the straws are received and accelerated, that is to say that they gain speed along that reception portion.

This is particularly advantageous since the straws, which are formed by a thin tube of plastic material, are liable to become charged with static electricity during the various manipulations they may undergo before being received in the supply and positioning device.

In particular, by virtue of the curved shape of the ramp, and more specifically the fact that its concave profile is oriented practically vertically at the location of the reception portion, the straws gain a sufficiently high speed for their sliding within the device not to be hindered by electrostatic forces.

By virtue of the installation according to the invention and in particular the ejection portion of its supply and positioning device, the straws are furthermore guided along the ramp and ejected from the latter in a predetermined orientation for their treatment.

It will be noted that the ejection portion preferably has an ejection free end, which is away from the reception portion, situated at the lowest point of the ramp.

It will also be noted that on the contrary the reception portion has a reception free end, which is away from the ejection free end, situated at the highest point of the ramp.

According to features which are simple, convenient and economical of the installation according to the invention, said treatment machine, referred to as first treatment machine, is disposed downstream of said supply and positioning device for treatment of said straws disposed in said predetermined orientation by said supply and positioning device; and said installation comprises a second treatment machine configured to receive, treat and eject said straws, said second treatment machine being disposed upstream of said supply and positioning device such that a straw ejected from said second treatment machine is received on said reception portion of said curved ramp of said supply and positioning device and accelerated to said ejection portion where said straw is guided and ejected in said predetermined orientation for the treatment of said straw by said first treatment machine.

The installation according to the invention thus makes it possible to place at least two treatment machines in series, with the supply and positioning device being interposed between these two machines.

In particular, the supply and positioning device forms both a hopper for collection of the straws treated by the second machine and a hopper for supplying the first machine with straws.

By virtue of the shape of the ramp (see above), the straws are simply conveyed, without being hindered and in a way that is guided from the second machine to the first machine; which makes it possible to provide a continuous process for successive treatments of the straws.

According to other simple, convenient and economical features of the installation according to the invention:

said supply and positioning device is mounted on said first treatment machine or said second treatment machine;

said second treatment machine comprises a device for conveying said straws which is configured to dispose said straws in said predetermined orientation and eject them one by one, such that said straws are received one by one on said reception portion of said curved ramp of said supply and positioning device while being disposed in said predetermined orientation;

said conveying device comprises conveyor belts each having a plurality of grooves forming accommodations configured to receive said straws in said predetermined orientation, said conveyor belts each having a portion oriented substantially vertically situated at the exit of said conveying device; said conveying device further comprising ejection members configured to extract, from said accommodations, said straws located in said portions of said conveyor belts that are substantially vertically oriented; said supply and positioning device being disposed such that said reception portion of said ramp is situated vertically opposite said portions of said conveyor belts that are substantially vertically oriented;

said second treatment machine is a filling and welding machine configured to fill each of said straws with a predetermined dose of liquid based substance and to weld said filled straws; while said first treatment machine is a printing machine configured to apply predefined marking on each of said filled and welded straws;

said concave profile of said curved ramp is trochoidal;

said concave profile is cycloidal;

said concave profile of said curved ramp extends over a height comprised between 20 and 100 mm;

the length of said concave profile of said curved ramp is comprised between 30 mm and 150 mm;

said supply and positioning device comprises several said curved ramps regularly spaced apart from each other and configured for each to enter into contact with a respective portion of a straw received by said supply and positioning device;

said treatment machine comprises a treatment unit and a conveying device configured to receive said straws disposed in said predetermined orientation and to convey them to said treatment unit, said conveying device having a guiding groove extending in said predetermined orientation and configured to slidingly receive said straws; and said supply and positioning device comprises a rotary magazine disposed opposite said ejection portion, said magazine being provided with a cylindrical body and with a plurality of longitudinal cut-outs formed on the periphery of said cylindrical body and each forming an accommodation extending in said predetermined orientation; said magazine being configured to receive in the accommodation of any one of said cut-outs a straw leaving said curved ramp;

said magazine is disposed in superposed relationship to said guiding groove of said conveying device and is configured to release said straw from said cut-out opposite said guiding groove for the insertion of said straw into said guiding groove;

said supply and positioning device comprises a base on which is fastened said curved ramp, said magazine being mounted for rotation on said base; and/or said supply and positioning device comprises an insertion mechanism for inserting said straws into said cut-outs of said magazine, said mechanism comprising a movable finger and a roller mounted on a distal end of said movable finger, said finger being movable between a first position in which said roller is at a distance from said ejection portion of said curved ramp and a second position in which said roller is in the immediate vicinity of said ejection portion; said mechanism being configured to cause said movable finger to pass from its first position towards it second position so as to push a straw leaving said ejection portion into a cut-out of said magazine situated facing said ejection portion.

BRIEF DESCRIPTION OF THE DRAWINGS

The disclosure of the invention will now be continued with the detailed description of embodiments, given below by way of non-limiting illustration, with reference to the appended drawings. In these.

DETAILED DESCRIPTION OF EMBODIMENTS

Figure 1:
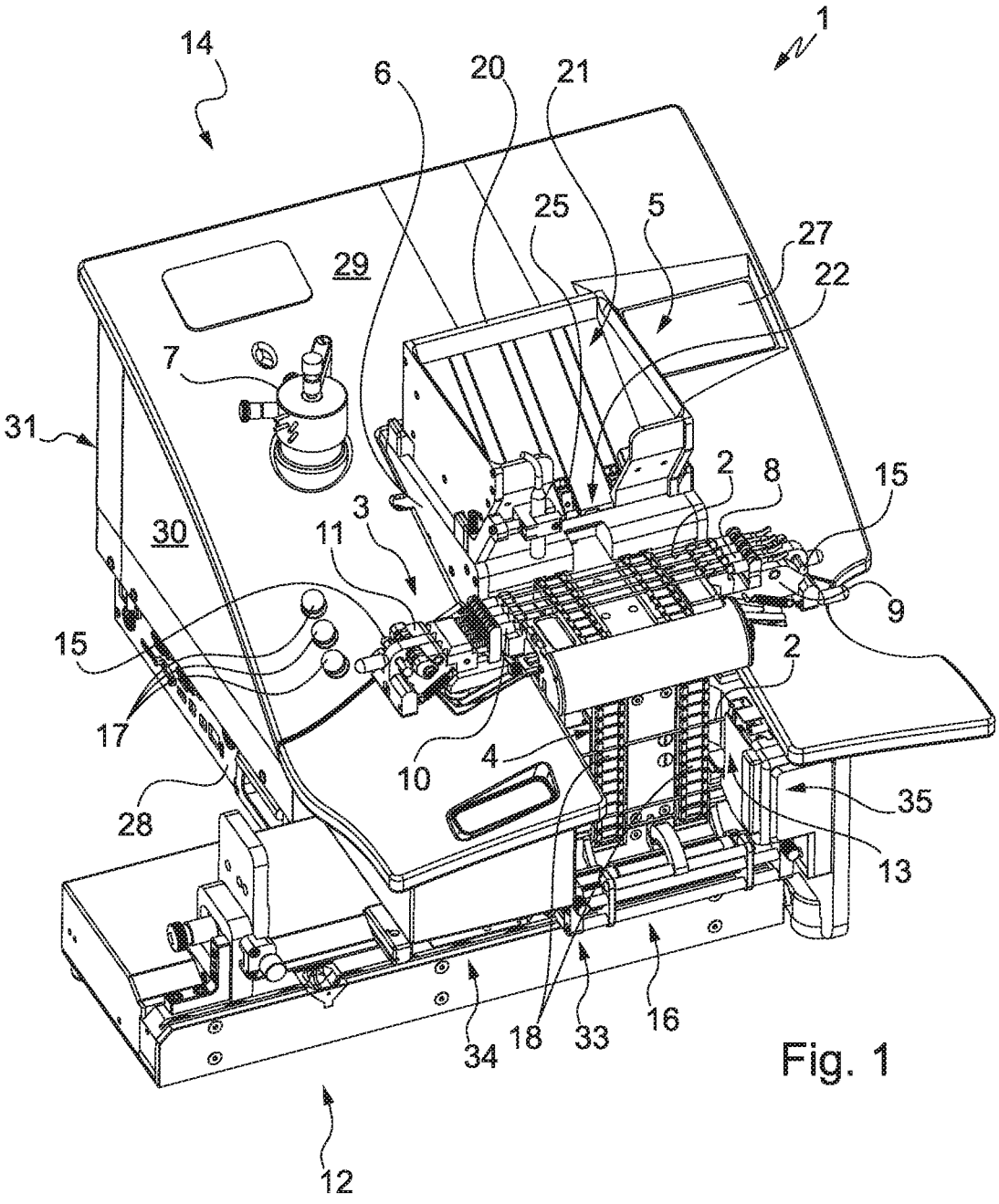
FIG. 1 illustrates, diagrammatically and in perspective, a treatment installation in particular for filling, welding and printing of straws, comprising a filling and welding machine and a printing machine disposed in series, as well as a device for supply and positioning straws disposed at the exit of the filling and welding machine and at the entry of the printing machine.
Figure 2:
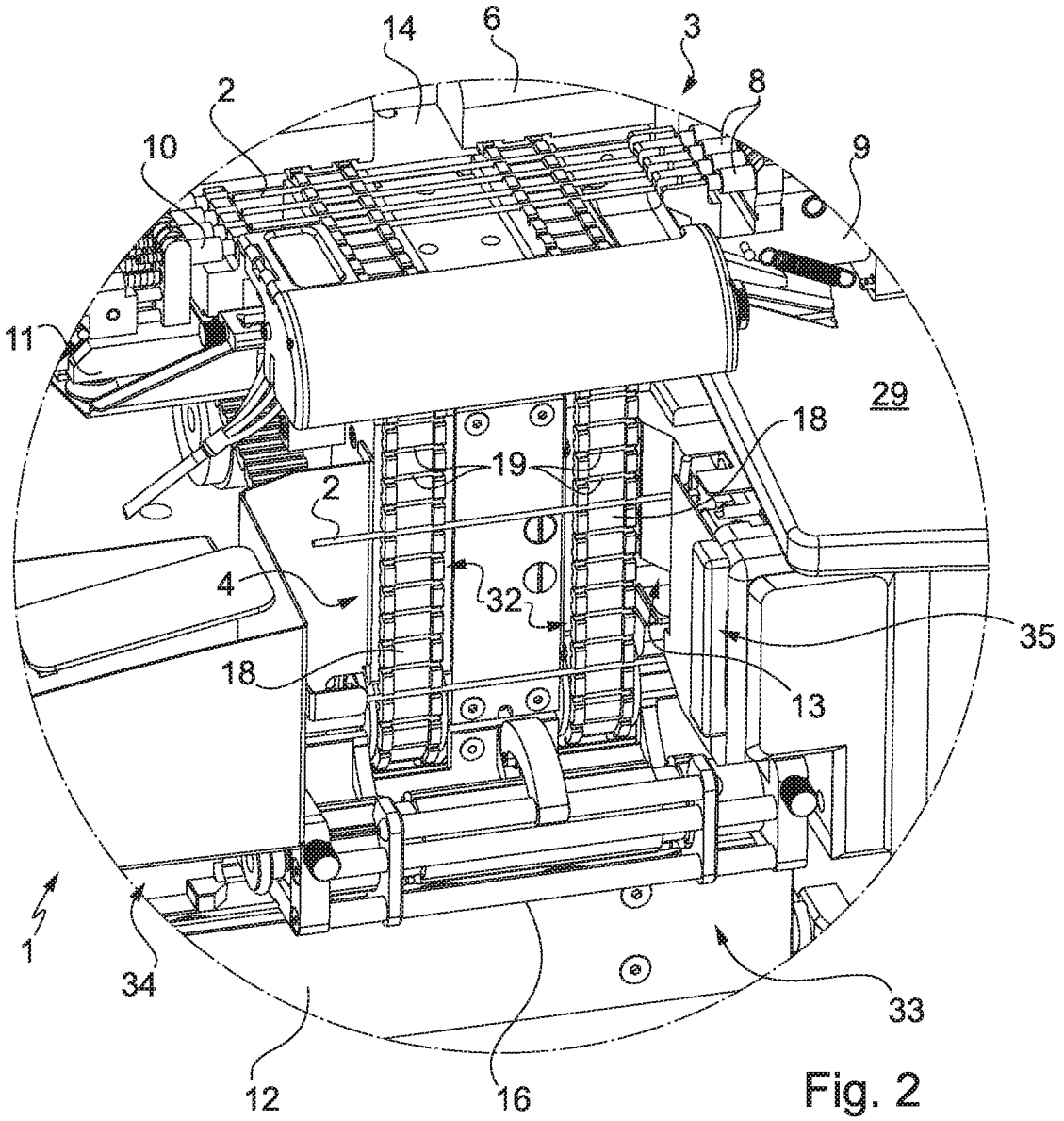
FIG. 2 illustrates an enlargement in perspective of part of the installation of FIG. 1 in which is disposed the device for supply and positioning straws.

FIGS. 1 and 2 illustrate an installation 1 for treatment of straws 2 for packaging a predetermined dose of liquid-based substance, here animal semen.

The treatment installation 1 here is an installation for the filling, the welding and the printing of straws 2 and comprises a first treatment machine, here a machine for printing straws 2, a second treatment machine 14, here a filling and welding machine for straws 2, and a supply and positioning device 16 disposed at the exit of the second treatment machine 14 and at the entry of the first treatment machine.

In other words, the filling and welding machine 14 is situated upstream of the device 16, whereas the printing machine 12 is situated downstream of the device 16.

The device 16 is configured to receive, from the filling and welding machine 14, straws 2 that are filled and welded, and to supply the printing machine 12 with these filled and welded straws 2.

More specifically, the device 16 is configured to dispose the straws 2 one by one in a predetermined orientation, for their treatment by the printing machine 12.

The treatment installation 1 further comprises a storage device (not illustrated) for storing, at least temporarily, the straws 2, which is disposed at the exit of the printing machine 12.

The filling and welding machine 14 comprises a treatment device 3, here a device for filling and welding straws 2, a movable support 4 which is configured to convey the straws 2 to the filling and welding device 3, as well as a hopper 5 configured to receive the straws 2 and position them on the movable support 4, for the filling and the welding of the straws 2.

The treatment device 3, the movable support 4 and the hopper 5 are here mounted on a frame 6 of the filling and welding machine 14.

The straws 2 for packaging animal semen extend generally longitudinally and are formed by a thin tube of plastic material having two free ends and by a stopper engaged in the thin tube (not shown). This stopper is formed by two plugs of fibrous substance which enclose a powder which transforms on contact with a liquid, into an impermeable gel or paste adhering to an inside wall of the tube, in order for the stopper to be fluid-tight.

The filling and welding device 3 comprises a pump mechanism 7, provided in particular with a vacuum pump, filling nozzles 8 mounted on a first movable carriage 9, suction nozzles 10 mounted on a second movable carriage 11 which is disposed facing the first movable carriage 9, and with a reservoir of animal semen (not shown).

The filling nozzles 8 and the suction nozzles 10 are configured to cooperate with the straws 2 and to enable their filling.

The filling nozzles 8 and the suction nozzles 10 are mounted on the first and second movable carriages 9 and 11 to be movable parallel to the length of the straws 2 between an advanced filling position and a withdrawn position.

The filling and welding device 3 further comprises a welding station 13 configured to weld the ends of the straws 2 after filling.

More specifically, FIGS. 1 and 2 show the straws 2 in course of cooperation with filling nozzles 8 and suction nozzles 10.

Before filling, the stopper of each straw 2 is disposed in the neighborhood of a first of the ends of the tube of the straw 2 and it is provided that in the filled state, the dose of animal semen which must be preserved in the straw 2 is disposed between the stopper and a second of the ends of the tube which is the furthest from the stopper.

To fill each straw 2, the first end of the tube is placed in communication by virtue of the suction nozzle 10 with the pump mechanism 7 whereas the second end is placed in communication by virtue of the filling nozzle 8 with the reservoir containing the semen to introduce into the tube of the straw 2.

The air initially contained between the stopper of the straw 2 and the second end is sucked through the stopper whereas the semen progresses within the tube of the straw 2 until it encounters its stopper.

The filling nozzle 8 comprises a needle connected to the reservoir via a flexible pipe (not shown) connected to a connector tip of the filling nozzle 8.

The suction nozzle 10 comprises a needle connected to the pump mechanism 7 via a flexible pipe (not shown) connected to a connector tip of the suction nozzle 10.

The filling and welding device 3 further comprises pinch members 15 of each of the flexible pipes enabling the fluidic communication to be interrupted or allowed between the needle of the suction nozzle 10 and the reservoir and between the needle of the filling nozzle 8 and the pump mechanism 7.

It will be noted that the first and second movable carriages 9 and 11 are each provided with several filling nozzles 8 and suction nozzles 10 to enable the filling of several straws 2 at the same time.

The pinch members 15 are configured to interrupt or allow, at the same time, the fluidic communication of all the pipes connected to the filling nozzles 8 and suction nozzles 10.

The filling and welding device 3 further comprises solenoid valves 17 configured to shunt at least one of the suction nozzles 10, by pinching the flexible pipe linking it to the pump mechanism 7.

Once the straws 2 are in the filled state, they are conveyed to the welding station 13 and are welded in the neighborhood of the second end of the tube, or even also in the neighborhood of the first end of the tube, then they are collected for cold storage.

The movable support 4 is formed by two conveyor belts 18 each having a plurality of grooves forming accommodations 19 (visible in particular in FIGS. 2 and 7) that are configured to receive the straws 2 in a predetermined orientation.

The movable support 4 is configured to convey the straws 2 thus accommodated on the latter, from the hopper 5 to the filling and suction nozzles 8 and 10 for filling the straws 2, then from these nozzles to the welding station 13 for welding of the straws 2.

The conveyor belts 18 each have, at the exit of the machine 14, a portion oriented substantially vertically, referred to as vertical portion 32 (FIG. 2).

The filling and welding machine 14 further comprises ejection members (not shown) configured to extract, from the accommodations 19, the filled and welded straws 2, when they are located in the vertical portions 32 of the conveyor belts 18.

The conveyor belts 18 and the ejection members here form a conveying device.

Thus, the straws 2 which are conveyed in a predetermined orientation by the conveyor belts 18, are here, once filled and welded, ejected one by one by the ejection members at the exit of the filling and welding machine 14, with that predetermined orientation.

The hopper 5 comprises a supply container 20 having an internal space 21 configured to receive a plurality of straws 2, as well as an evacuation channel 22 open to the internal space 21 of the supply container 20 and furthermore open facing the accommodations 19 of the movable support 4.

The hopper 5 here further comprises a separating system 25 configured to impart movement to the straws 2 in the internal space 21 of the supply container 20.

In operation, the straws 2 are inserted into the internal space 21 of the supply container 20, are agitated by the separating system 25, and enter, one after the other, into the vertical channel 22. Next, the straws 2 fall, one after the other, into a respective accommodation 19 on the conveyor belts 18 of the movable support 4.

The filling and welding machine 14 further comprises a control-command screen 27 connected to a control-command unit (not shown) of the machine 14, for the implementation in particular of the steps of filling and welding the straws 2, as well as a supply and connection box 28 having an interface provided with a plurality of ports for information technology and electrical connection which are connected in particular to the control-command unit.

The frame 6 of a machine 14 is at least partly covered with adorning panels, here formed in particular by a front panel 29, two lateral panels 30 (only one of which is visible in FIG. 1), and a back panel 31.

The frame 6 is arranged so as to provide a recess 33 having a first portion 34 which extends generally horizontally at the bottom of the filling and welding machine 14, and a second portion 35 which extends generally vertically facing the vertical portions 32 of the conveyor belts 18.

The printing machine 12 and the supply and positioning device 16, which is mounted here on the printing machine 12, are fitted into the recess 33.

The printing machine 12 is partly received in the first portion 34 while the supply and positioning device 16 is partly received both in the first portion 34 and in the second portion 35.

The supply and positioning device 16 is disposed facing and at the bottom of the vertical portions 32 of the conveyor belts 18, from which the straws 2 are ejected.

The supply and positioning device 16 thus forms a hopper for collecting straws 2 for the filling and welding machine 14, situated at the exit of the latter.

Figure 3:
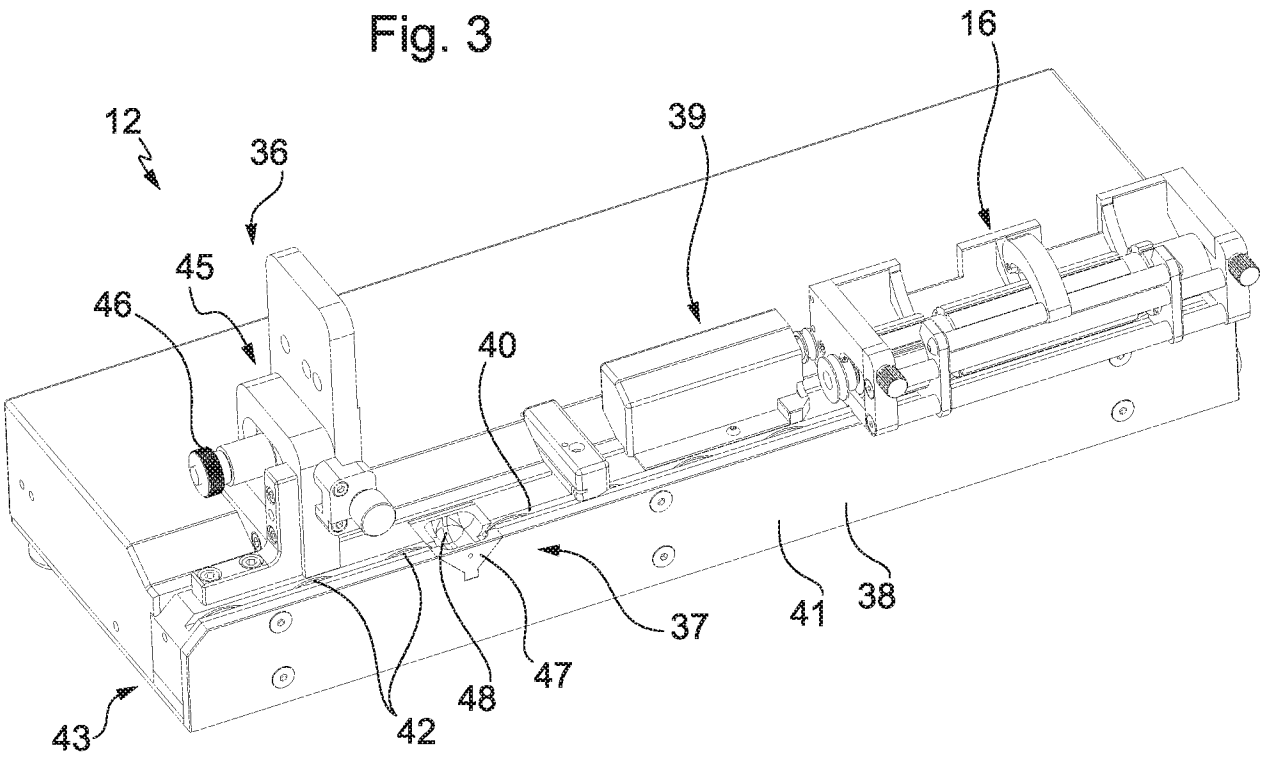
FIG. 3 is a similar view to FIG. 1, showing the printing machine and the supply and positioning device without the filling and welding machine.
Figure 4:
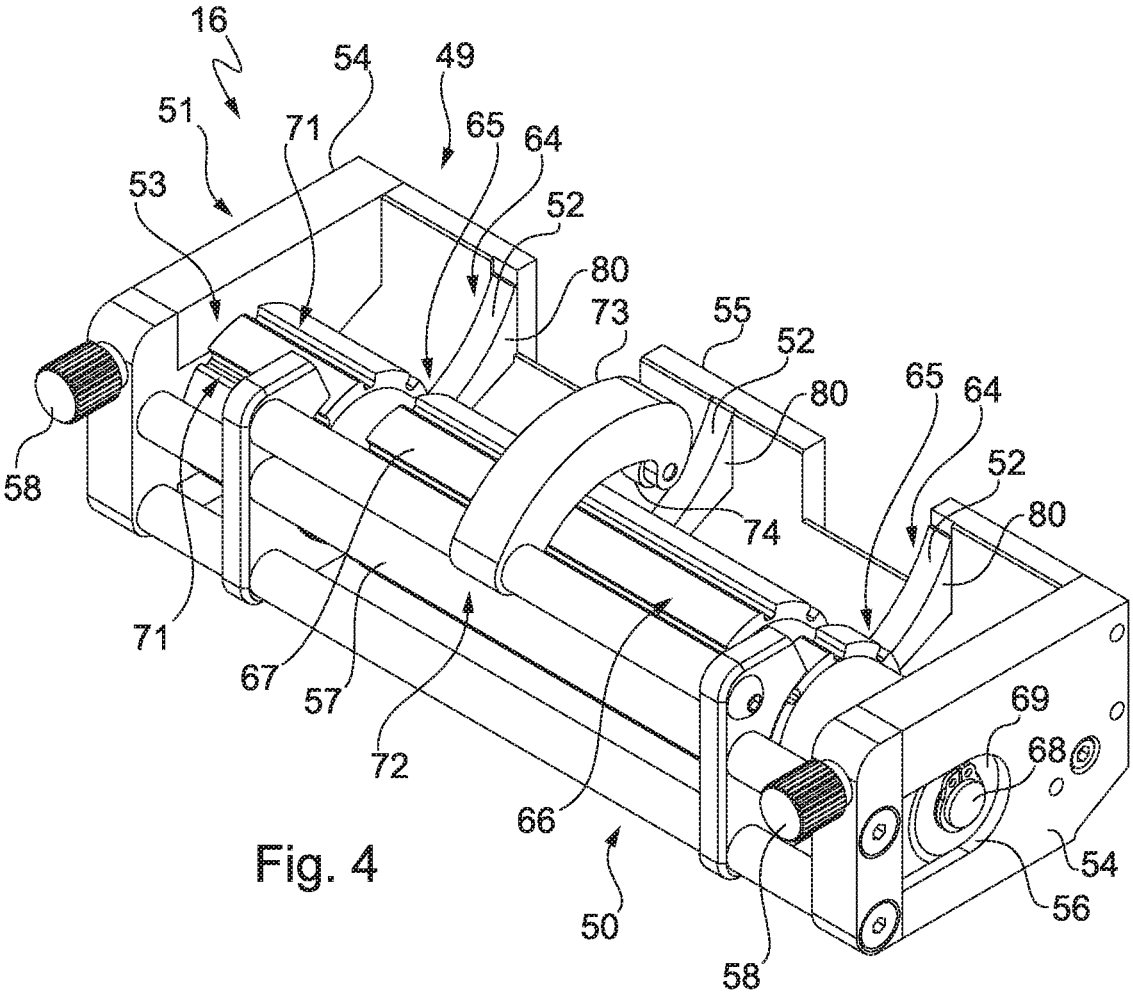
FIGS. 4 and 5 illustrate the supply and positioning device, taken in isolation, in perspective and from two different viewing angles.

A description will now be given of the printing machine 12 with reference to FIG. 3.

The step of printing straws 2 is characterized by the fact of applying predefined marking (not shown) to each straw, for example identification marking having in particular a reference to a batch number for straws, the origin and/or destination of the animal semen, etc.

The printing machine 12 comprises a unit 36 for treatment, here printing, configured to apply the predefined marking on each straw 2 and a device 37 for conveying the straws 2 from the supply and positioning device 16 to the printing unit 36, and also from the printing unit 36 to the exit of the printing machine 12, where the straws 2 are ejected with a predetermined orientation to be received in the storage device.

The supply and positioning device 16 here forms a hopper for supply and positioning for the printing machine 12, situated at the entry of the latter.

The printing machine 12 further comprises a frame 38 on which is securely attached the supply and positioning device 16.

The printing machine 12 further comprises a drive unit 39, mounted on the frame 38, adjacent the device 16, and configured to cooperate with the device 16.

The conveying device 37 is formed by a groove 40 provided longitudinally in a body 41 of the frame 38 and forming an accommodation for the straws 2, the groove 40 being configured to receive the straws 2 slidingly in the accommodation.

The conveying device 37 is furthermore formed by roller wheels 42 accommodated in the groove 40 and disposed in a regular arrangement along that groove 40 between the entry and the exit of the printing machine 12.

The conveying device 37 comprises a rotational drive mechanism for the roller wheels 42 to enable the conveyance of the straws 2 when they are located in the accommodation.

The conveying device 37 further comprises, at one end 43 of the groove 40, at the exit of the printing machine 12, a wheel (not shown) mounted with freedom to rotate in the groove 40 and configured to hold the straws 2 in their predetermined orientation when they are ejected from the groove 40, for being received in the storage device.

The printing unit 36 comprises a mounting 45 having a fixed part securely mechanically connected to the frame 38 of the printing machine 12, and a movable part configured to be movable relative to the fixed part under the action of an adjustment wheel 46 of the mounting 45.

The printing unit 36 further comprises a printing head (not shown) fastened to the movable part of the mounting 45 so as to be adjustable in position, and a cord (not shown) also called umbilical cord, configured to supply in particular the printing head with ink to apply the marking to the straws 2.

The printing unit 36 further comprises an inkwell 47 embedded in the frame 38, in alignment with the axis of the groove 40, between two successive roller wheels 42.

The inkwell 47 is provided with a bowl 48 disposed transversely to the groove 40 and partially interrupting it, such that the groove 40 opens into the bowl 48 by two facing apertures situated on respective opposite sides of the bowl 48 and forming a passage for the straws 2 across the inkwell 47.

When it is mounted on the movable part of the mounting 45, the printing head is disposed in superposed relationship to the bowl 48 of the inkwell 47, at the location of the groove 40 in which pass the straws 2, and is adjustable in position for the printing of these latter.

It will be noted that the inkwell 47 is configured here to enable the printing of the straws 2 while collecting possible projections of ink occurring in the immediate vicinity of the printing head.

The storage device is situated in a predetermined position at the exit of the printing machine 12, facing the end 43 of the groove 40, from which are ejected the straws 2, so as to receive them for their storage, which is at least temporary.

A description will now be given of the supply and positioning device 16 with reference to FIGS. 4 to 7.

The supply and positioning device 16 has an inlet part 49 for the straws 2, by which the straws 2 are received by the device 16, and a discharge part 50 for the straws 2, away from the inlet part, by which the straws 2 leave the device 16.

The supply and positioning device 16 comprises a base 51, several guide members 80 (here three in number) each securely attached to the base 51 in the inlet part 49 of the device 16, and a discharge system 53 mounted on the base 51 of the discharge part 50 of the device 16.

The base 51 is substantially parallelepiped here and comprises two lateral cheeks 54 disposed facing each other and a back wall 55 fastened to the cheeks 54 and extending from one to the other of these cheeks 54, in the inlet part 49 of the device 16.

The discharge part 50 of the base 51 has two apertures 56 facing each other, each formed in a respective cheek 54.

The base 51 further comprises a front wall 57, which is an opposite wall to the back wall 55, removably fastened to the cheeks 54 and extending from one to the other of these cheeks 54, in the discharge part 50 of the device 16.

The front wall 57 here comprises two manually operable clamp members 58, each being configured to fasten the front wall 57 to a respective lateral cheek 54.

Figure 5:
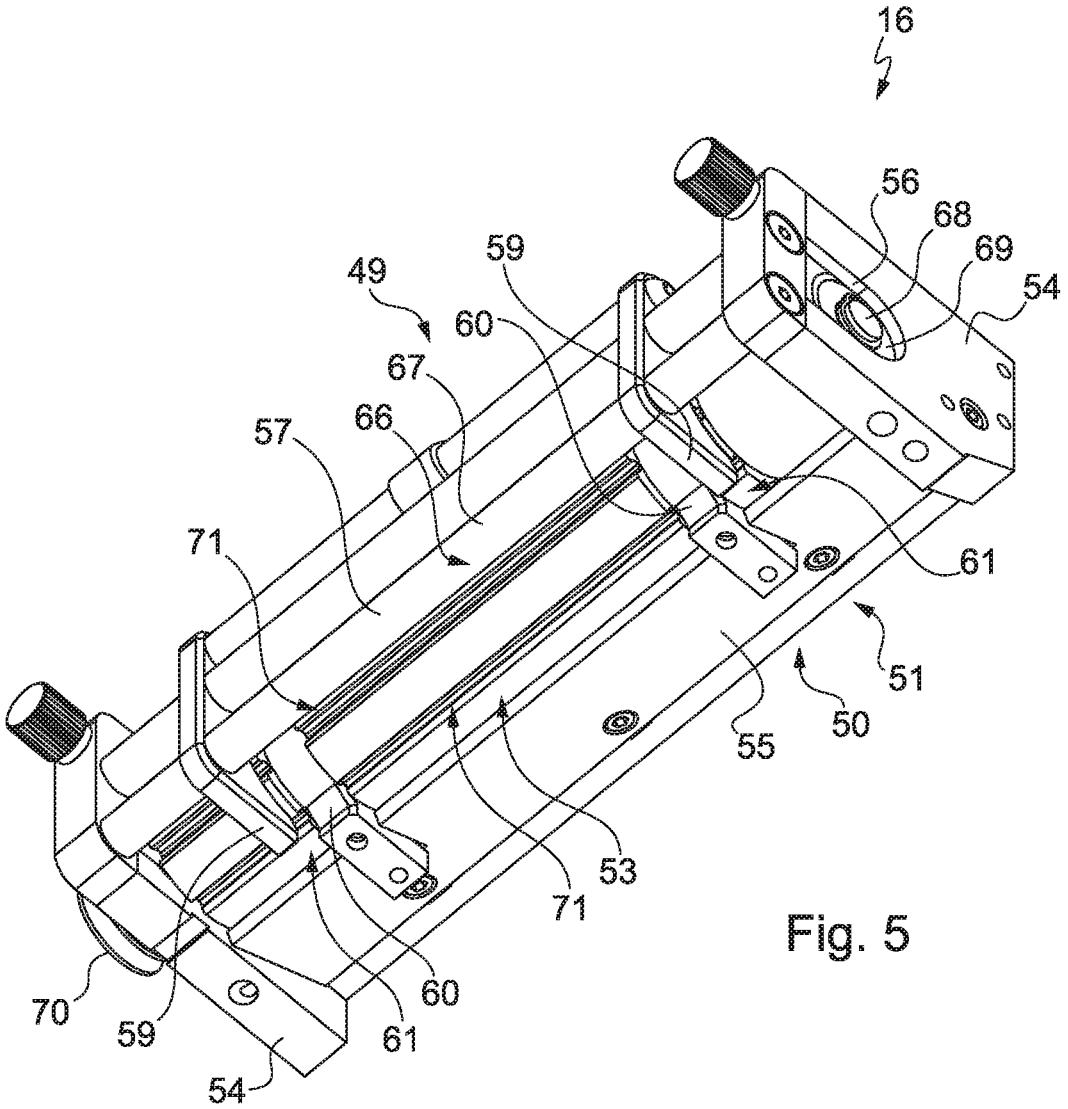
Figure 7:
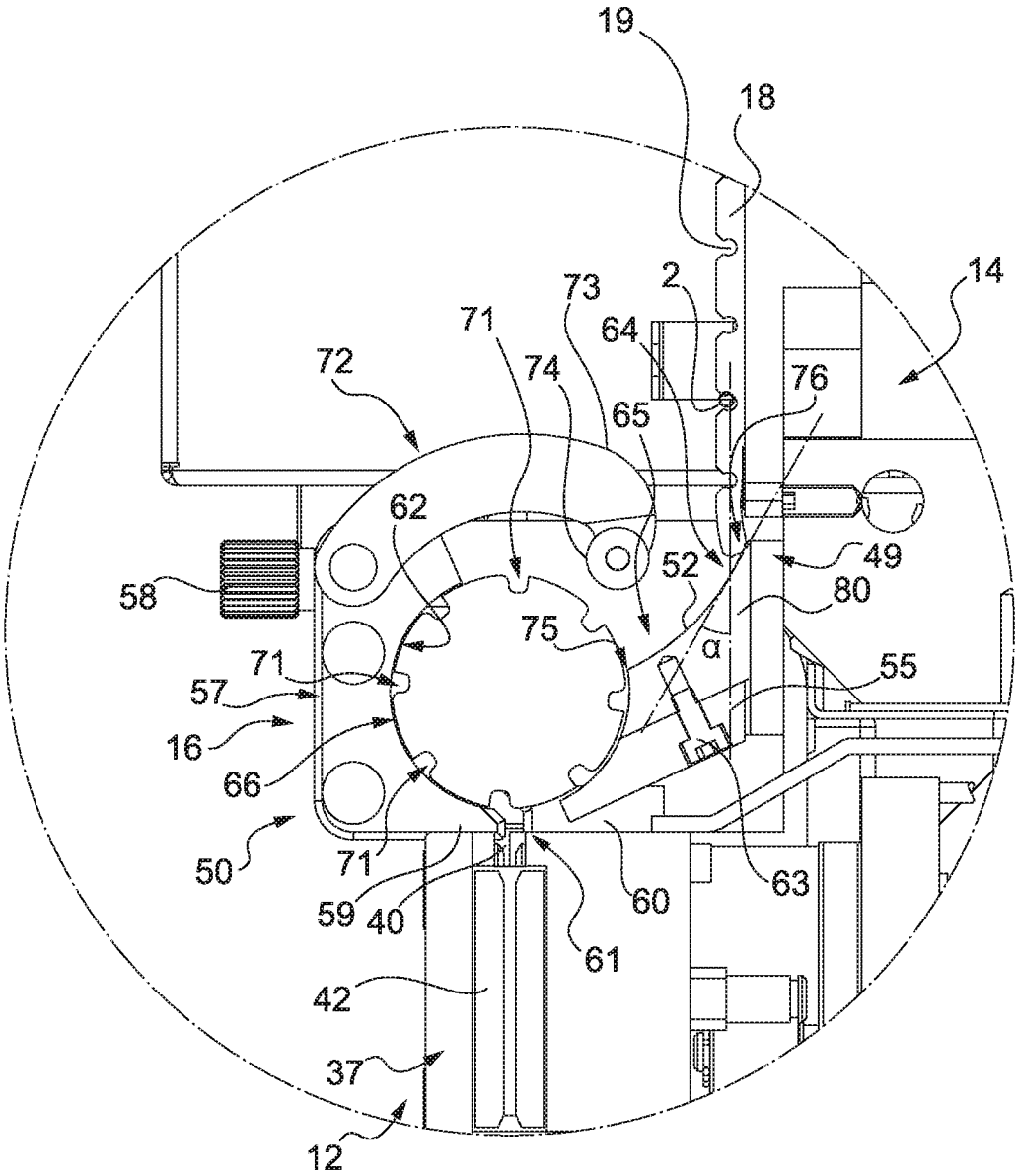
FIG. 7 is the cross-section view on VII-VII of FIG. 6.

The front wall 57 here furthermore has two front extensions 59 which project towards the back wall 55, and the back wall 55 here has two back extensions 60 which project towards the front wall 57 (FIGS. 5 and 7).

The front extensions 59 and the back extensions 60 delimit between them a discharge passage 61 for the straws 2, which passage 61 is situated at the bottom of the discharge part 50 of the device 16 and extends facing the groove 40 of the conveying device 37 of the printing machine 12.

Each front extension 59 here forms part of a cheek having a curved edge 62, extending facing the back wall 55 and of which the concavity is directed towards the back wall 55 (FIG. 7).

The guide members 80 are added members mounted on the back wall 55 using fasteners, here screws 63 (FIG. 7).

Each guide member 80 has, on the opposite side to the back wall 55, a curved surface forming a curved ramp 52 for guiding the straws 2.

The curved ramps 52 are identical here, regularly spaced from each other, and uniformly distributed between the lateral cheeks 54.

Each ramp 52 has a reception portion 64 for the straws 2 and an ejection portion 65 for the straws 2, away from the reception portion 64 and situated lower than the latter. In other words, the ejection portion 65 is situated downstream of the reception portion 64.

Each ramp 52 has a concave profile turned upwardly. The concave profile is furthermore turned towards the discharge part 50 of the device 16.

The concave profile thus has an orientation, that is to say a slope, closer to the vertical in the reception portion 64 than in the ejection portion 65.

In the reception portion 64, the slope of the concave profile deviates from the vertical by an angle alpha (FIG. 7) here approximately equal to 45 degrees. More generally, the angle alpha may be comprised between 30 degrees and 45 degrees.

The concave profile is of trochoidal type here, more specifically of cycloidal type.

Such a cycloidal profile corresponds to the path of a point fixed to the periphery of a disk rolling without sliding along a straight line. This cycloidal profile would have been obtained here by a circle of diameter approximately equal to 40 mm. More generally, the diameter may be comprised between 30 mm and 50 mm.

The length of the concave profile is approximately 30 mm here. More generally, the length may be comprised between 30 mm and 150 mm.

The concave profile here extends over a height of approximately 20 mm. More generally, the height is comprised between 20 and 100 mm. This height corresponds to the difference in altitude between the highest point and the lowest point of the concave profile, which are respectively situated in the reception portion 64 and in the ejection portion 65 of the curved ramp 52.

It will be noted that the ejection portion 65 here has an ejection free end 75, which is away from the reception portion 64, situated at the lowest point of the ramp 52 (FIG. 7).

It will also be noted that on the contrary the reception portion 64 has a reception free end 76, which is away from the ejection free end 75, situated at the highest point of the ramp 52.

The concave profile of the curved ramp extends here over an angular sector of less than a quarter turn. More generally, the concave profile extends over an angular sector of at most approximately a quarter turn, that is to say that the directions normal to the concave profile respectively in the reception portion 64 and in the ejection portion 65 form an angle between them of at most approximately 90 degrees.

Each curved ramp 52 is configured to convey, to the ejection portion 65, a straw 2 received on the reception portion 64 and sliding freely on the ramp 52.

Thus, a straw 2 received on the reception portion 64 is accelerated to the ejection portion 65 where the straw 2 is guided and ejected with a predetermined orientation.

The discharge system 53 comprises a magazine 66 rotatably mounted on the base 51 and disposed horizontally opposite the ejection portion 65 of the ramp 52.

It will also be noted that the magazine 66 is disposed in superposed relationship to the groove 40 of the conveying device 37.

The magazine 66 is provided with a cylindrical body 67, with a drive shaft 68 fastened to the cylindrical body 67, and two rolling bearings 69 mounted on the drive shaft 68 on respective opposite sides of the cylindrical body 67.

Each rolling bearing 69 is engaged in an aperture 56 of a respective lateral cheek 54 so as to form, with the respective lateral cheek 54, a rolling bearing assembly for the drive shaft 68.

It will be noted that the magazine 66 is disposed here such that the curved edges 62 of the cheeks forming the front extensions 59 fit to the cylindrical shape of the magazine 66 over practically the entire height of its side that is turned towards the front wall 57.

The magazine 66 furthermore has a pulley 70 (FIG. 5) joined to the drive shaft 68 and configured to be rotationally driven via a belt of the drive unit 39 of the printing machine 12, so as to rotationally drive the magazine 66.

The magazine 66 has a plurality of longitudinal cut-outs 71 formed on the periphery of the cylindrical body 67. These longitudinal cut-outs 71 each form an accommodation extending in the predetermined orientation which the straws 2 have when they leave the ejection portion 65 of the curved ramp 52.

Each of these accommodations is configured to receive a straw 2 in said predetermined orientation.

When the magazine 66 is in rotation, the longitudinal cut-outs 71 come one after the other to face the ejection portion 65 of the curved ramp 52. These cut-outs 71 may thus receive, one after the other in their accommodation, a straw 2 leaving the curved ramp 52.

The magazine 66 is configured such that, when the cut-out 71 receiving a straw 2 arrives to face the discharge passage 61, the straw 2 is released and escapes from the supply and positioning device 16 through the discharge passage 61. This straw 2 is thus released opposite the groove 40 of the conveying device 37, to enter that groove 40.

It will be noted that the groove 40 extends longitudinally with a predetermined orientation which the straws 2 have when they are discharged from the device 16.

The discharge system 53 further comprises an insertion mechanism 72 for inserting the straws 2 into the cut-outs 71 of the magazine 66.

The insertion mechanism 72 comprises a movable finger 73 having a proximal end by which it is rotatably mounted on the front wall 57 of the base 51, and a roller 74 mounted on a distal end of the movable finger 73.

The finger 73 is movable between a first position in which the roller 74 is at a distance from the ejection portion 65 of the curved ramp 52 and a second position in which the roller 74 is in the immediate vicinity of the ejection portion 65.

The insertion mechanism 72 is configured to pass the movable finger 73 from its first position to its second position so as to push a straw 2 leaving the ejection portion 65 to insert it into a cut-out 71 of the magazine 66 situated facing the ejection portion 65.

During the operation of the installation 1 for treatment of straws 2, these latter successively reside in the container 20 of the filling and welding machine 14, then on the conveyor belts 18 before being ejected one by one, filled and welded, at the exit of the filling and welding machine 14, to the supply and positioning device 16 situated downstream.

Figure 6:
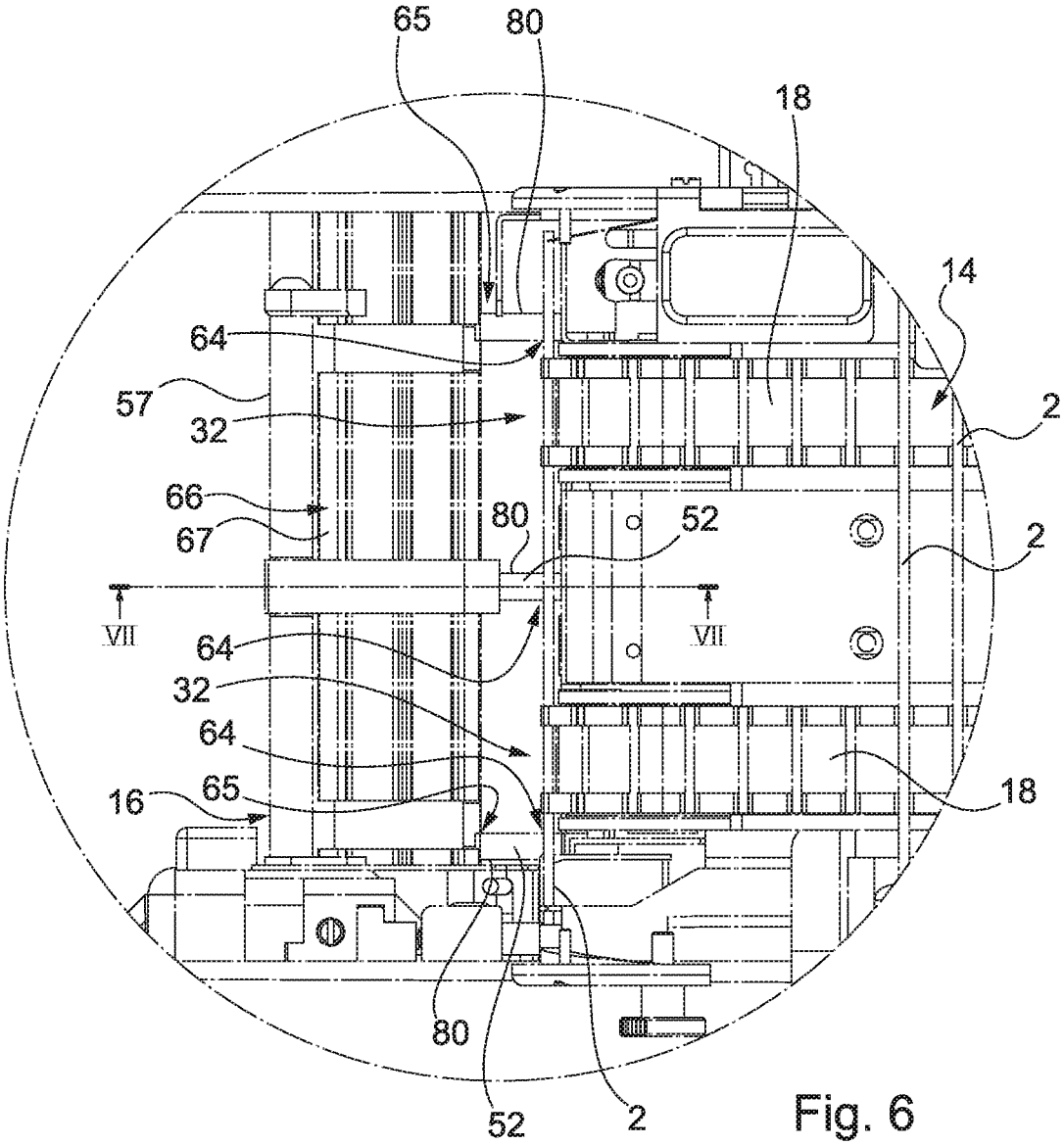
FIG. 6 illustrates from above the enlargement that can be seen in FIG. 2

As illustrated in particular in FIGS. 6 and 7, the supply and positioning device 16 is here disposed such that the reception portions 64 of the curved ramps 52 are each situated vertically opposite the vertical portions 32 of the conveyor belts 18. Furthermore, the straws 2 are ejected with a predetermined orientation.

The straws 2 are thus received one by one on the reception portions 64 of the curved ramps 52 of the supply and positioning device 16, with that predetermined orientation.

It will be noted that the three curved ramps 52 each receive a respective portion of the straw 2. A first of the ramps 52 enters into contact with a first end portion of the straw 2, a second of the ramps 52 enters into contact with a second end portion of the straw 2, which is away from the first end portion, and a third of the ramps 52 enters into contact with a central portion of the straw 2 extending between its first and second end portions.

It will also be noted that the straws 2 are ejected from the conveyor belts 18 when they are situated in the immediate vicinity of the reception portions 64 of the curved ramps 52.

Thus, the straws 2 are taken practically immediately to be guided by the curved ramps 52.

It will be noted that the conveyor belts 18 change orientation in the vicinity of the reception portions 64 and are thus locally deformed. This deformation tends to open the grooves forming the accommodations 19, which promotes the ejection of the straws 2 out of the accommodations 19.

Furthermore, the straws 2 are ejected here in the immediate vicinity of the reception free ends 76, that is to say in the immediate vicinity of the location at which the concave profile of the curved ramps 52 has a an orientation which is closest to the vertical.

Figure 8:
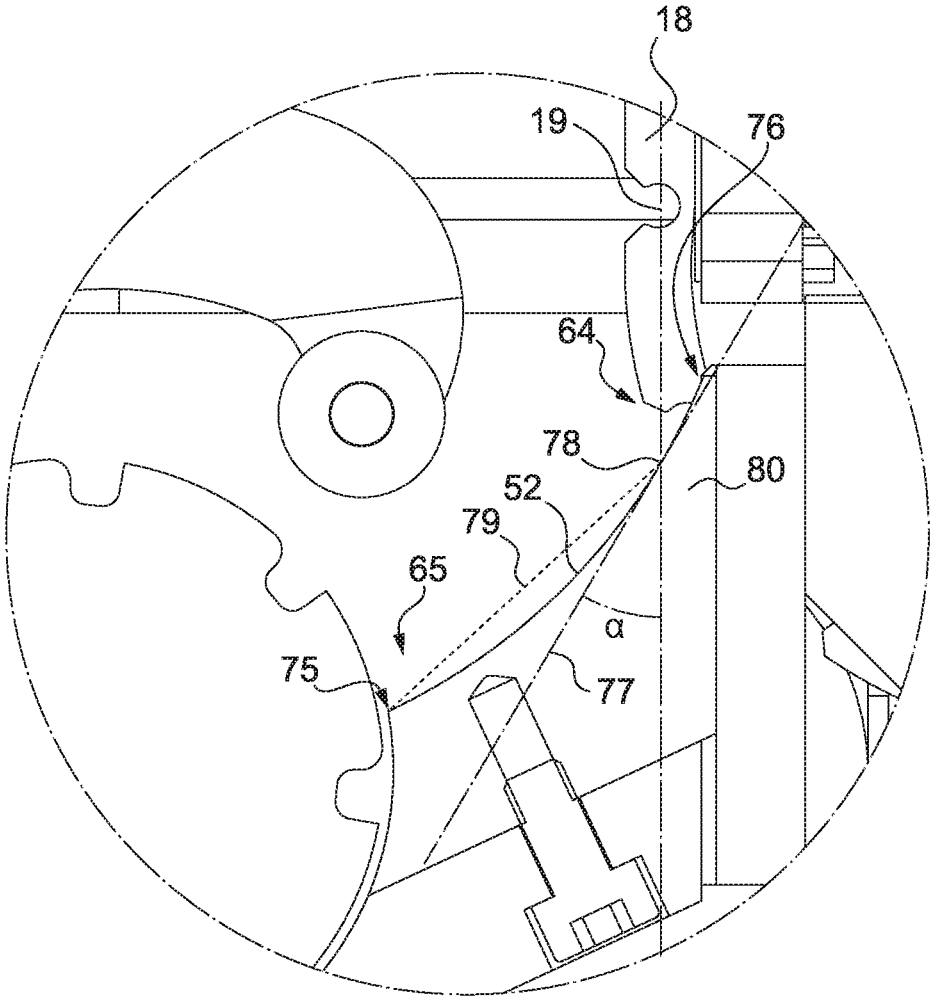
FIG. 8 illustrates an enlargement of FIG. 7.

It will be noted that in FIGS. 7 and 8, the angle alpha which the slope of the concave profile makes with the vertical is measured at the location at which the straw 2 enters into contact with the curved ramp 52; the slope of the concave profile corresponding here to the tangent 77 to the concave profile at the point of contact 78 between the straw 2 and the curved ramp 52.

It will be noted that this contact point 78 could, as a variant, be located nearer the reception free end 76.

By virtue of the installation 1 and in particular the reception portion 64 of the supply and positioning device 16, the straws 2 are received and accelerated, that is to say that they gain speed along that reception portion 64.

This is particularly advantageous since the straws 2, which are formed by a thin tube of plastic material, are liable to become charged with static electricity during the various manipulations they may undergo before being received in the supply and positioning device, and in particular during their residence in the filling and welding machine 14.

In particular, by virtue of the curved shape of the ramp 52, and more specifically the fact that its concave profile is oriented practically vertically at the location of the reception portion 64, the straws 2 gain a sufficiently high speed for their sliding within the device 16 not to be hindered by electrostatic forces.

In FIG. 8, by way of comparison, there is represented in dashed line an inclined planar surface 79 extending from the point of contact 78 to the ejection free end 75.

It will be noted that on such a planar surface 79, the straw 2 would during its fall acquire less speed than on the curved ramp 52 with a cycloidal profile, such that the straw 2 would be more sensitive to electrostatic forces.

Furthermore, the falling time of the straw 2 on such an inclined planar surface 79 would be longer.

It will be noted that at the point of contact 78, the angular divergence relative to the vertical is smaller for the curved ramp 52 (angle alpha) than for the planar surface 79.

When movement takes place on the curved ramp 52 starting from that point of contact 78 until the ejection free end 75 is encountered, this angular divergence progressively reduces for the curved ramp 52, whereas it does not vary for the planar surface 79.

Thus, at the ejection free end 75, the angular divergence relative to the vertical is greater for the curved ramp 52 than for the planar surface 79.

By virtue of the installation 1 and in particular the ejection portion 65 of its supply and positioning device, the straws 2 are furthermore guided along the ramp 52 and ejected from the latter in a predetermined orientation, for their treatment by the printing machine 12.

The magazine 66, situated at the bottom of the ramp 52, is configured to discharge the straws 2 from the device 16 while maintaining the predetermined orientation that the straws 2 have when they leave the ejection portion 65 of the ramp 52.

The magazine 66 enables these straws to be discharged with a high cadence.

In variants that are not illustrated:

- the supply and positioning device is mounted on the filling and welding machine rather than on the printing machine or this device is mounted on a distinct mounting interposed between these two machines;
- the printing machine is upstream of the supply and positioning device, while the filling and welding machine is downstream of the supply and positioning device, the container of the filling machine being replaced by the supply and positioning device;
- the guide members comprising the curved ramps are not members added to the base but are integrally formed with the base;
- the number of curved ramps is different from three, for example the device only comprises a single ramp extending over a major part of the bottom of the base, or two ramps, or four ramps or more than four ramps; and/or
- the trochoidal profile is not cycloidal but may be an elongated or shortened trochoid, that is to say corresponding to the path of a point linked to a circle rolling on a straight line, but located respectively further outside the circle or further inside the circle.

Numerous other variants are possible according to circumstances, and in this connection it is to be noted that the invention is not limited to the examples described and shown.

The invention claimed is:

1. A treatment installation for straws for packaging a predetermined dose of liquid-based animal semen substance, comprising: at least one treatment machine for said straws and a supply and positioning device configured to receive said straws and dispose them one by one in a predetermined orientation for treatment of said straws by said machine; wherein said supply and positioning device comprises at least one curved ramp having a reception portion for receiving said straws and an ejection portion for ejecting said straws, which is away from said reception portion and wherein said ejection portion is situated lower than said reception portion, said curved ramp being configured to convey, to said ejection portion, a straw received on said reception portion and freely sliding on said ramp, said curved ramp having a concave profile turned upwardly such that said profile has an orientation closer to the vertical in said reception portion for receiving said straws than in said ejection portion for ejecting said straws, such that said straw received on said reception portion is accelerated to said ejection portion where said straw received on said reception portion is guided and ejected in said predetermined orientation for treatment of said straw received on said reception portion by said treatment machine.

2. The installation according to claim 1, wherein said treatment machine, referred to as a first treatment machine, is disposed downstream of said supply and positioning device for treatment of said straws disposed in said predetermined orientation by said supply and positioning device; comprising a second treatment machine configured to receive, treat and eject said straws, said second treatment machine being disposed upstream of said supply and positioning device such that a straw ejected from said second treatment machine is received on said reception portion of said curved ramp of said supply and positioning device and accelerated to said ejection portion where said straw ejected from said second treatment machine is guided and ejected in said predetermined orientation for the treatment of said straw ejected from said second treatment machine by said first treatment machine.

3. The installation according to claim 2, wherein said supply and positioning device is mounted on said first treatment machine or said second treatment machine.

4. The installation according to claim 2, wherein said second treatment machine comprises a device for conveying said straws which is configured to dispose said straws in said predetermined orientation and eject them one by one, such that said straws are received one by one on said reception portion of said curved ramp of said supply and positioning device while being disposed in said predetermined orientation.

5. The installation according to claim 4, wherein said conveying device comprises conveyor belts each having a plurality of grooves forming accommodations configured to receive said straws in said predetermined orientation, said conveyor belts each having a portion oriented substantially vertically situated at the exit of said conveying device; said conveying device further comprising ejection members configured to extract, from said accommodations, said straws located in said portions of said conveyor belts that are substantially vertically oriented; said supply and positioning device being disposed such that said reception portion of said ramp is situated vertically opposite said portions of said conveyor belts that are substantially vertically oriented.

6. The installation according to claim 2, wherein said second treatment machine is a filling and welding machine configured to fill each of said straws with a predetermined dose of liquid based substance and to weld said filled straws; while said first treatment machine is a printing machine configured to apply predefined marking on each of said filled and welded straws.

7. The installation according to claim 1, wherein said concave profile of said curved ramp is trochoidal.

8. The installation according to claim 7, wherein said concave profile is cycloidal.

9. The installation according to claim 1, wherein said concave profile of said curved ramp extends over a height comprised between 20 and 100 mm.

10. The installation according to claim 1, wherein the length of said concave profile of said curved ramp is comprised between 30 mm and 150 mm.

11. The installation according to claim 1, wherein said supply and positioning device comprises several said curved ramps regularly spaced apart from each other and configured for each to enter into contact with a respective portion of a straw received by said supply and positioning device.

12. The installation according to claim 1, wherein said treatment machine comprises a treatment unit and a conveying device configured to receive said straws disposed in said predetermined orientation and to convey them to said treatment unit, said conveying device having a guiding groove extending in said predetermined orientation and configured to slidingly receive said straws; and said supply and positioning device comprises a rotary magazine disposed opposite said ejection portion, said magazine being provided with a cylindrical body and with a plurality of longitudinal cut-outs formed on the periphery of said cylindrical body and each forming an accommodation extending in said predetermined orientation; said magazine being configured to receive in the accommodation of any one of said cut-outs a straw leaving said curved ramp.

13. The installation according to claim 12, wherein said magazine is disposed in superposed relationship to said guiding groove of said conveying device and is configured to release said straw that left said curved ramp from a cut-out that is opposite said guiding groove for the insertion of said straw that left said curved ramp into said guiding groove.

14. The installation according to claim 12, wherein said supply and positioning device comprises a base on which is fastened said curved ramp, said magazine being mounted for rotation on said base.

15. The installation according to claim 1, wherein said supply and positioning device comprises an insertion mechanism for inserting said straws into cut-outs of said magazine, said mechanism comprising a movable finger and a roller mounted on a distal end of said movable finger, said finger being movable between a first position in which said roller is at a distance from said ejection portion of said curved ramp and a second position in which said roller is in the immediate vicinity of said ejection portion; said mechanism being configured to cause said movable finger to pass from its first position towards it second position so as to push a straw leaving said ejection portion into a cut-out of said magazine that is situated facing said ejection portion.

* * * * *